US006871497B2

(12) United States Patent
Isogai

(10) Patent No.: US 6,871,497 B2
(45) Date of Patent: Mar. 29, 2005

(54) 4-STROKE RECIPROCATING PISTON ENGINE HAVING SUPERCHARGING PISTON

(76) Inventor: Daikichiro Isogai, 13-1-405 Okura 1-chome, Yahatahigashi-Ku Kitakyushu 805-0048 (JP)

( * ) Notice: Subject to any disclaimer, the term of this patent is extended or adjusted under 35 U.S.C. 154(b) by 183 days.

(21) Appl. No.: 10/440,257

(22) Filed: May 19, 2003

(65) Prior Publication Data

US 2004/0154560 A1 Aug. 12, 2004

(30) Foreign Application Priority Data

Feb. 6, 2003 (JP) ..... 2003-030117

(51) Int. Cl.[7] ..... F02B 33/44
(52) U.S. Cl. ..... 60/598; 123/559.1; 123/53.6
(58) Field of Search ..... 60/598; 123/559.1, 123/53.6, 54.1, 55.4, 55.5

(56) References Cited

U.S. PATENT DOCUMENTS 3,570,459 A * 3/1971 Combs ..... 123/51 BA
4,211,082 A * 7/1980 Bristol ..... 60/605.1
4,663,938 A * 5/1987 Colgate ..... 60/620
5,179,921 A * 1/1993 Figliuzzi ..... 123/198 C
5,873,339 A 2/1999 Isogai

FOREIGN PATENT DOCUMENTS

JP 3137283 2/2001

* cited by examiner

*Primary Examiner*—Hoang Nguyen
(74) *Attorney, Agent, or Firm*—Connolly Bove Lodge & Hutz LLP

(57) ABSTRACT

The invention provides a 4-stroke reciprocating piston engine having a supercharging piston, which ensures dynamic balance of the engine with only a simple construction and achieves high output. The 4-stroke reciprocating piston engine having a supercharging piston includes: two pairs of bidirectional reciprocating power pistons mounted at both ends of the crankshaft having three crank pins in series at the same phase; a pair of bidirectional reciprocating supercharging pistons mounted at the middle crank pin at a phase different by 180° with respect to the two pairs of bidirectional reciprocating power pistons; a cylinder head on which an air intake opening portion for the bidirectional reciprocating supercharging piston cylinder, a pressurized air intake opening portion from the bidirectional reciprocating supercharging piston cylinder, a pressurized air intake opening portion into the respective bidirectional power piston cylinders, and an exhaust opening portion from the respective bidirectional reciprocating piston cylinders are formed.

6 Claims, 11 Drawing Sheets

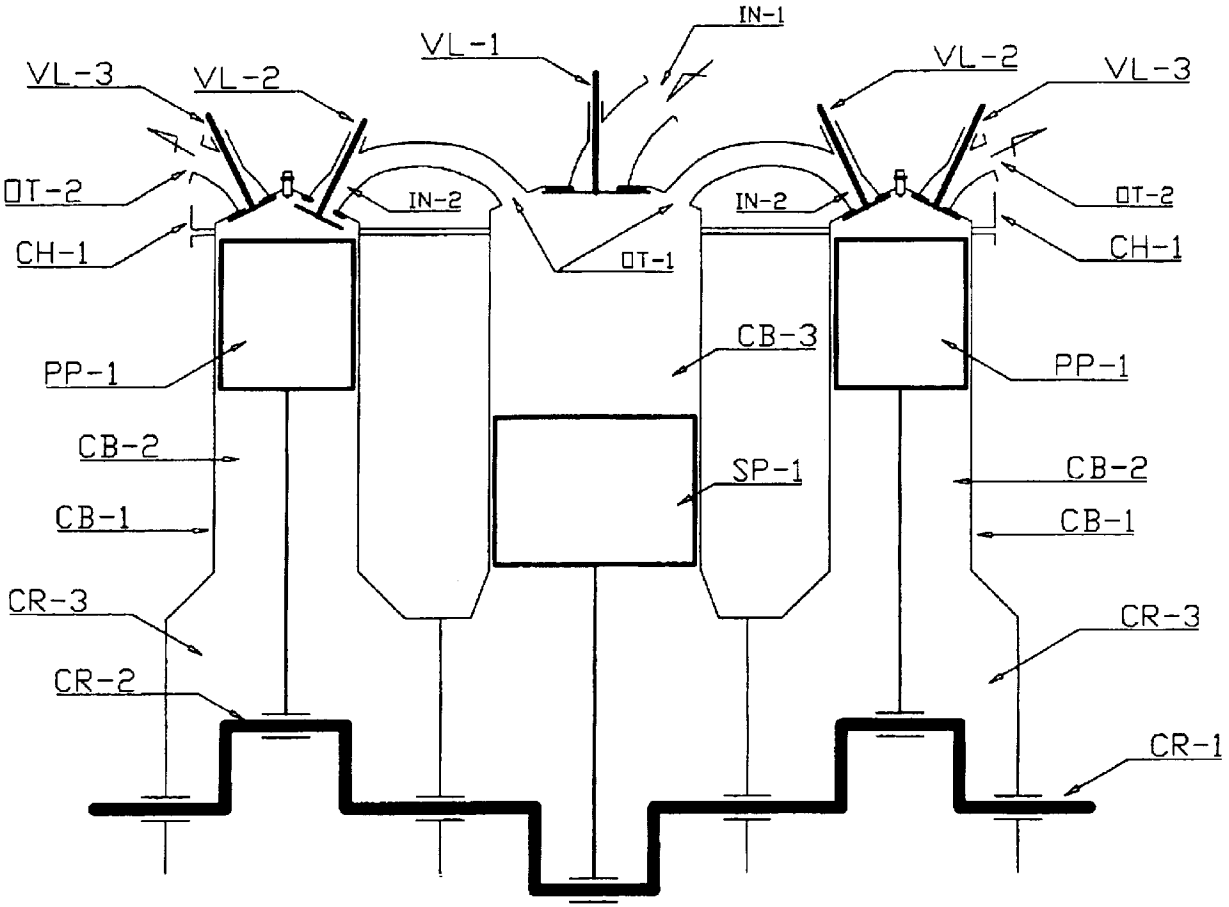
[FIG. 1]

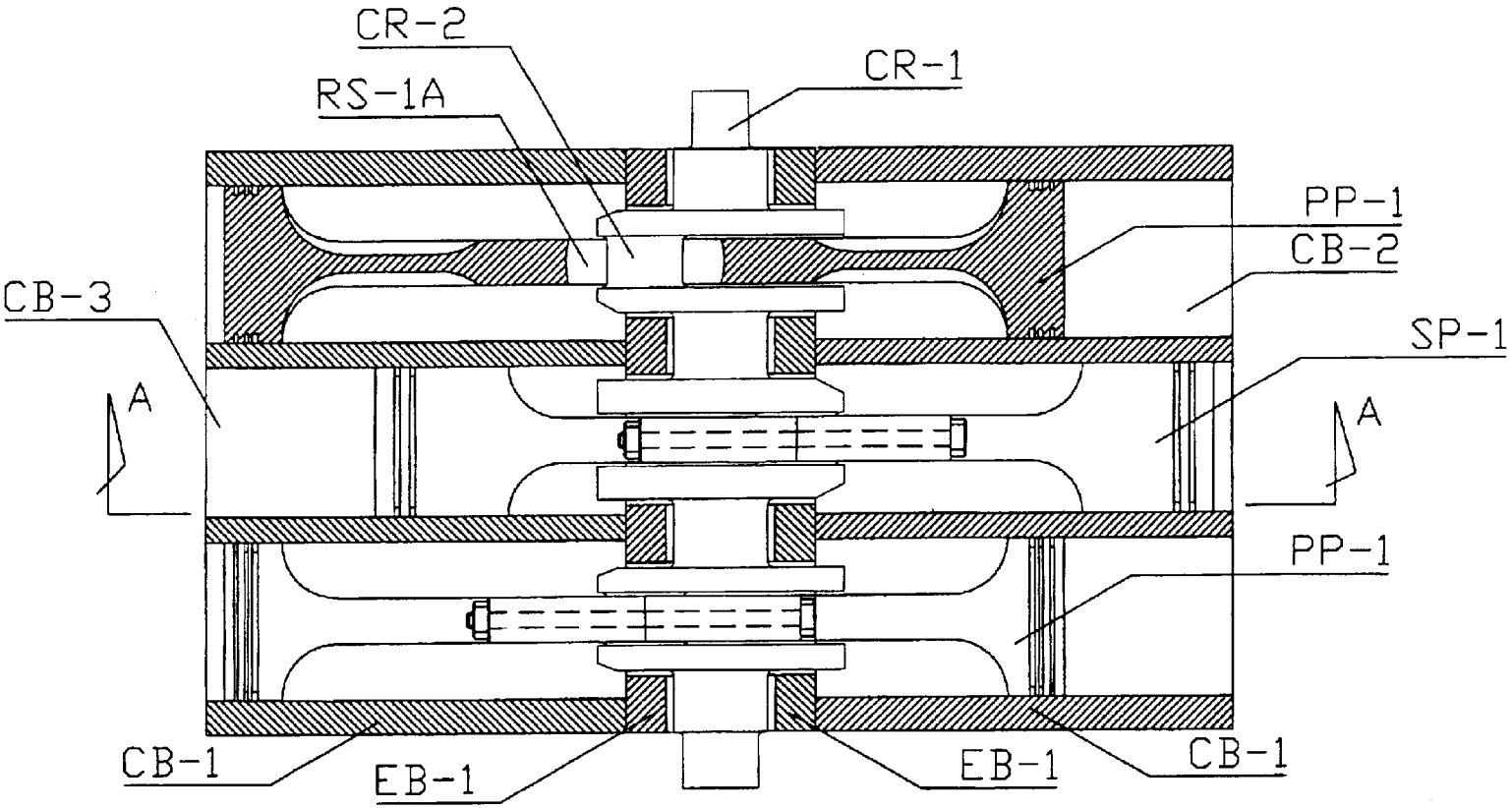
[FIG. 2]

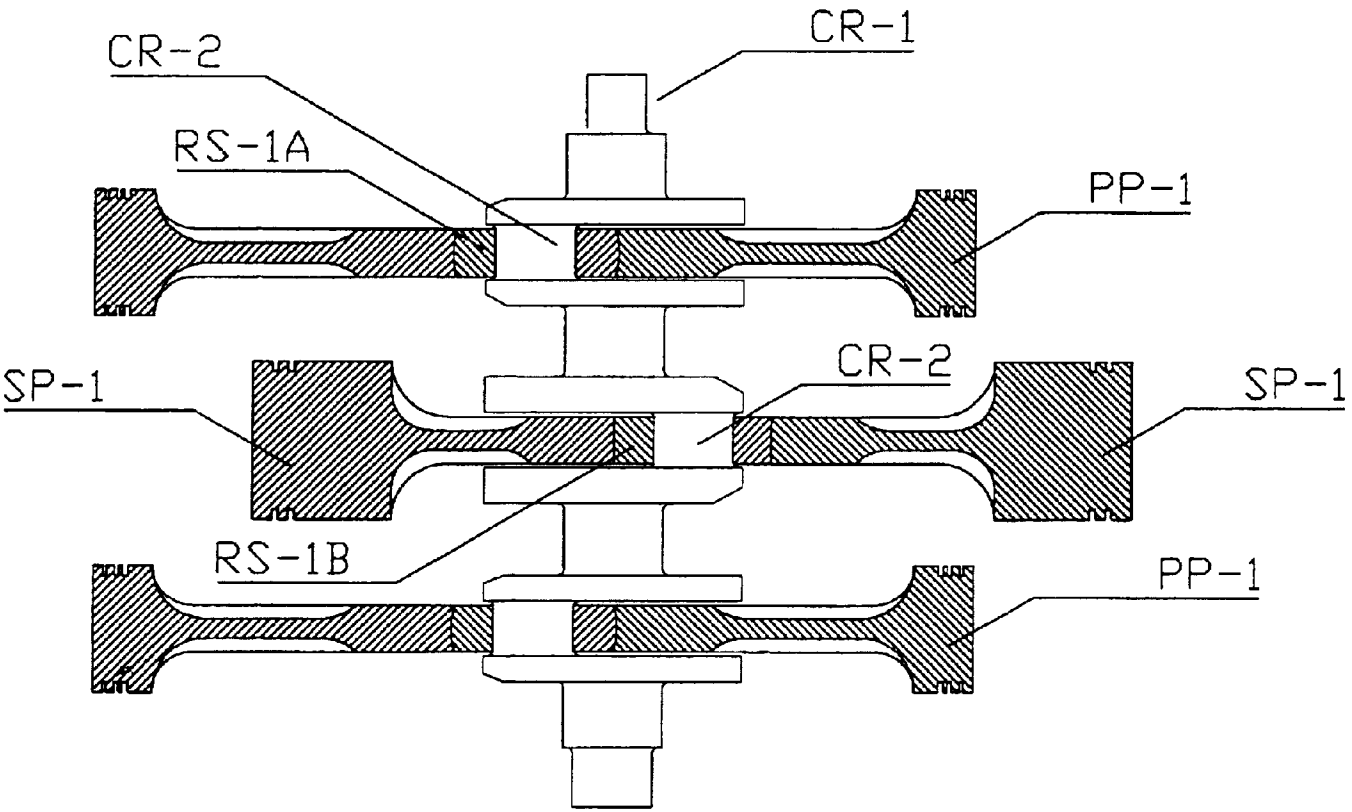
[FIG. 3]

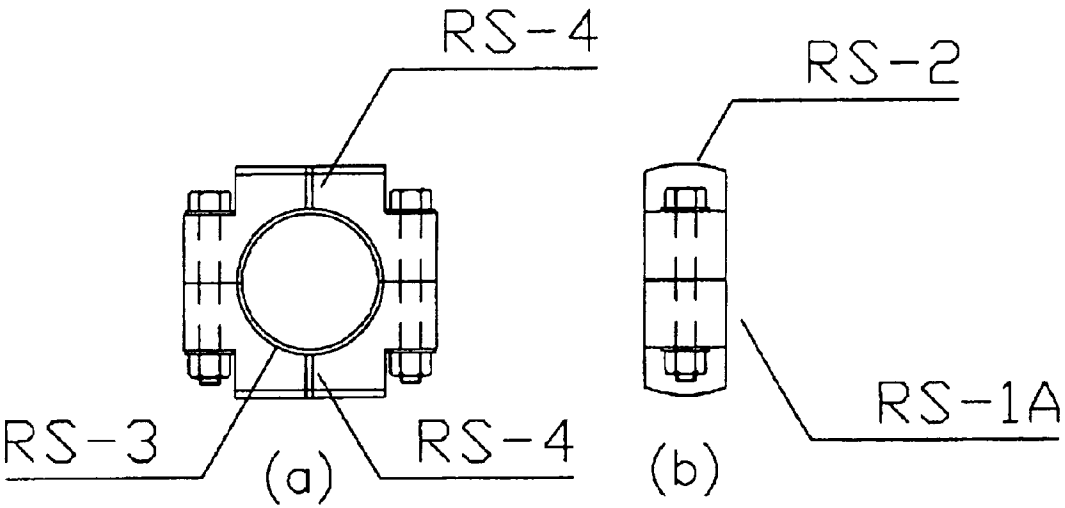
[FIG. 4]

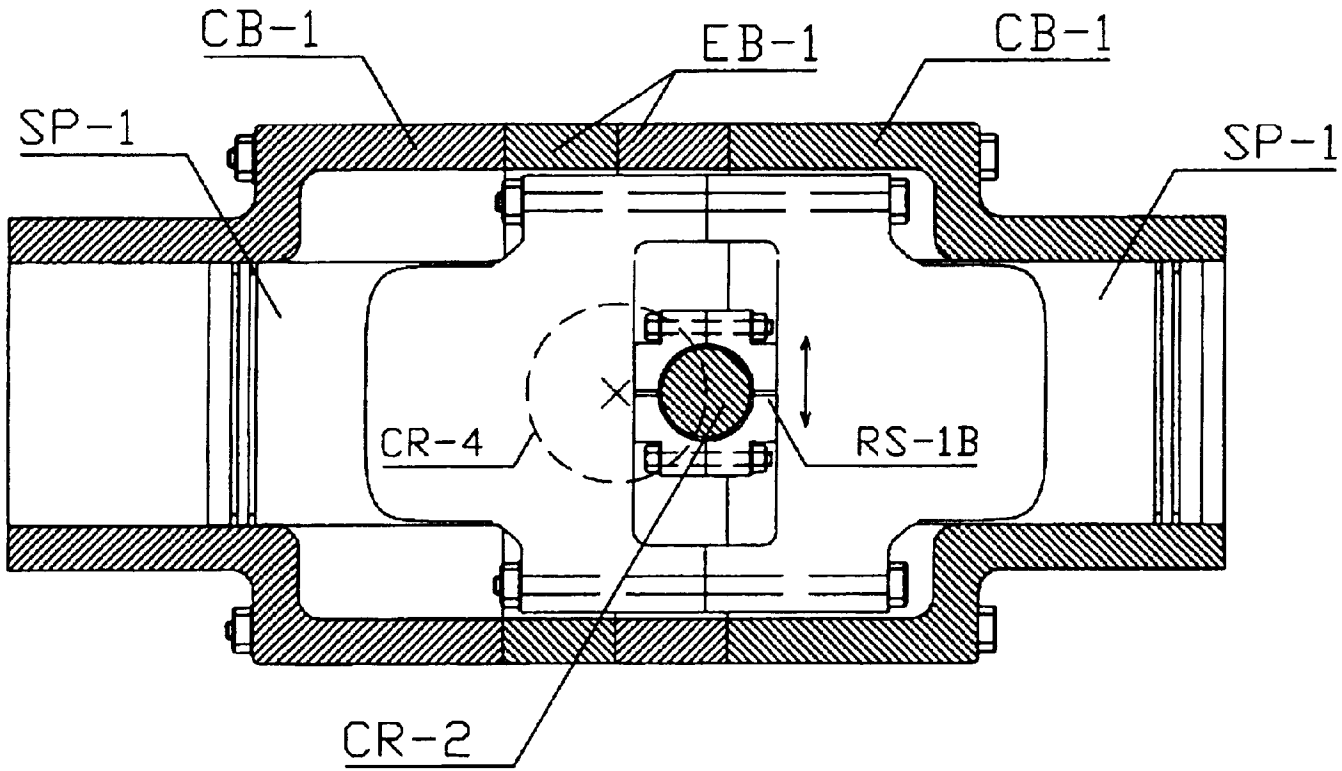
[FIG. 5]

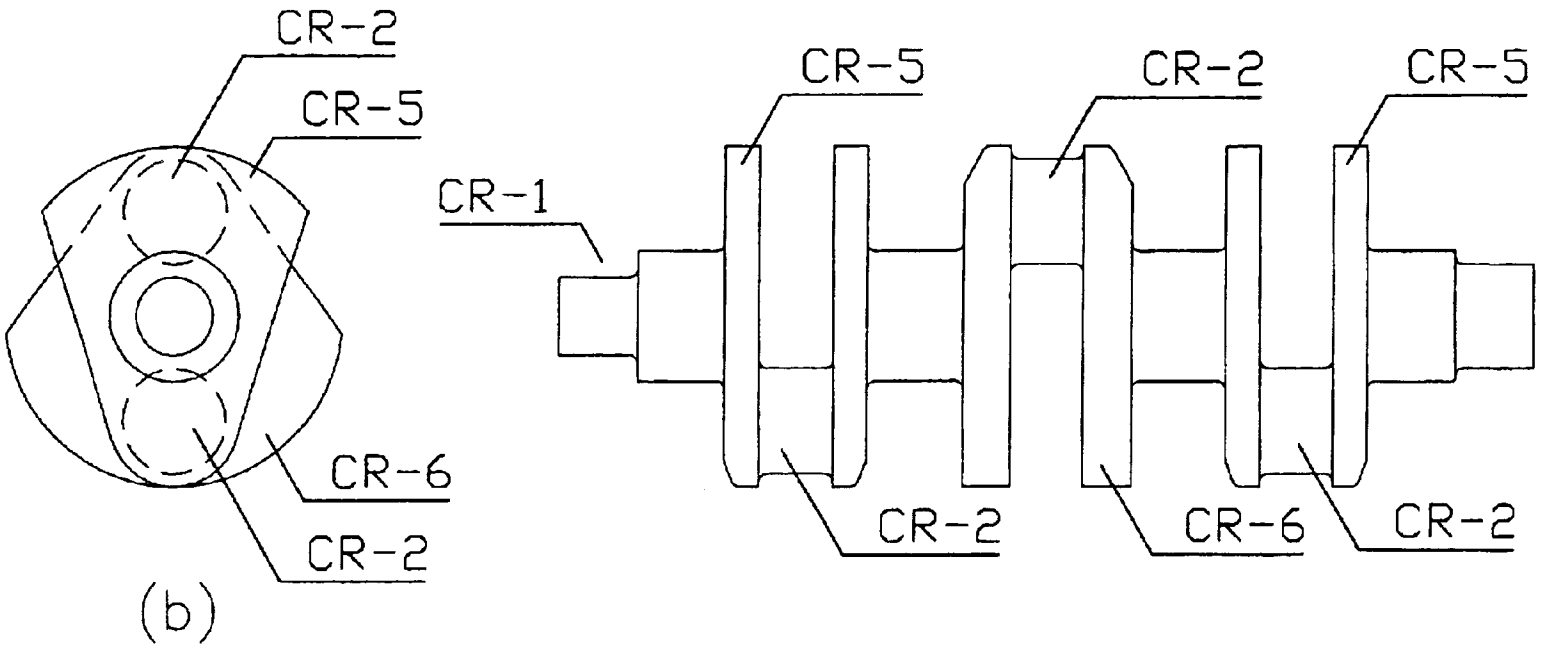
[FIG. 6]

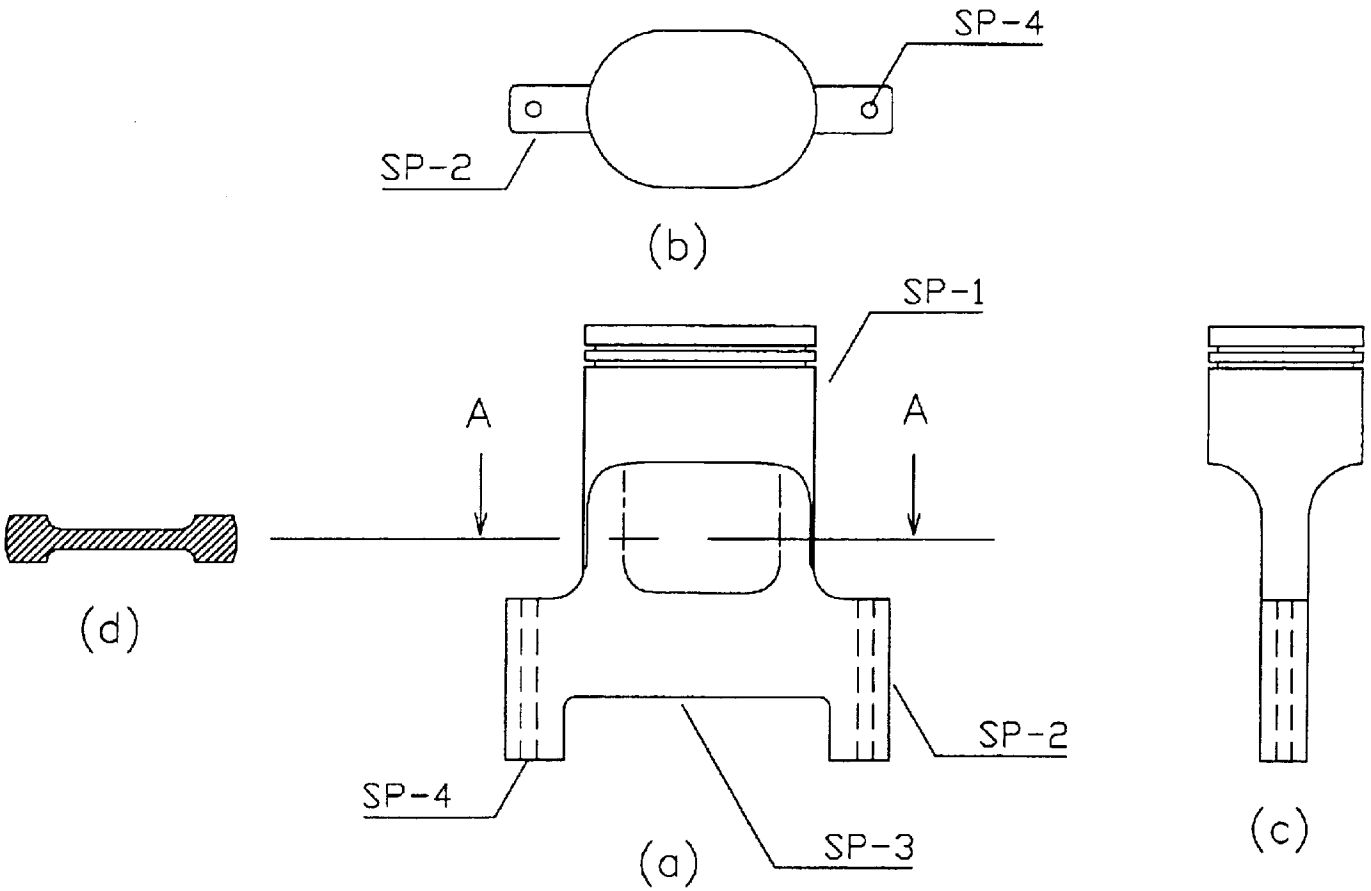
[FIG. 7]

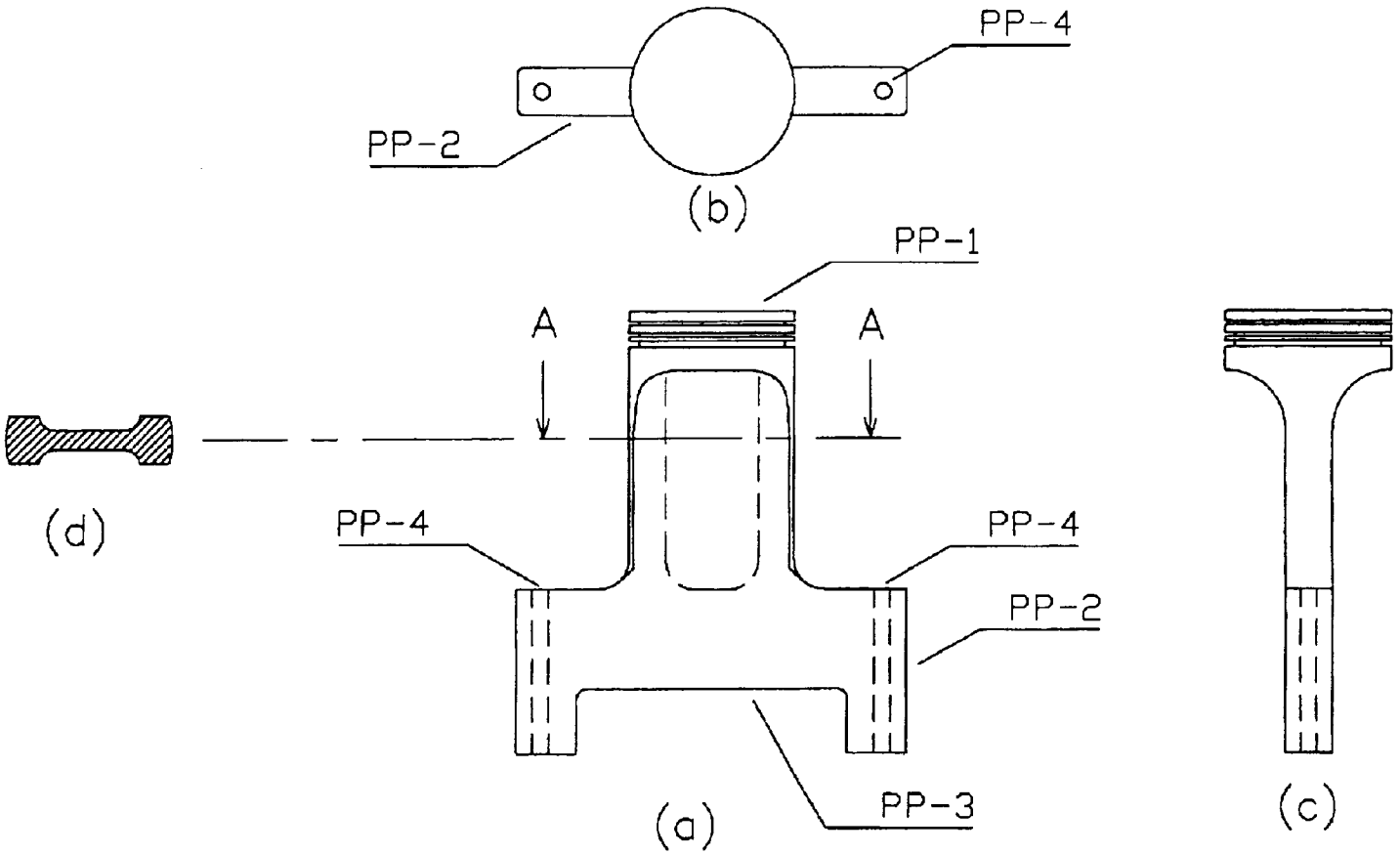
[FIG. 8]

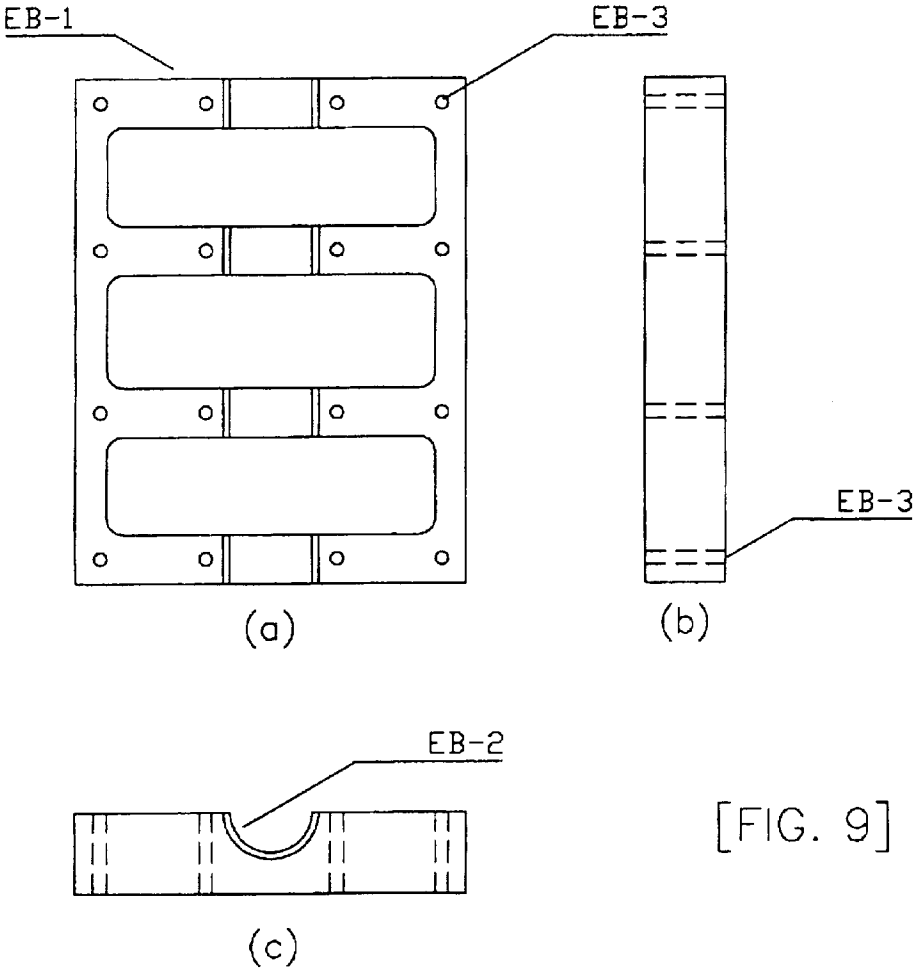
[FIG. 9]

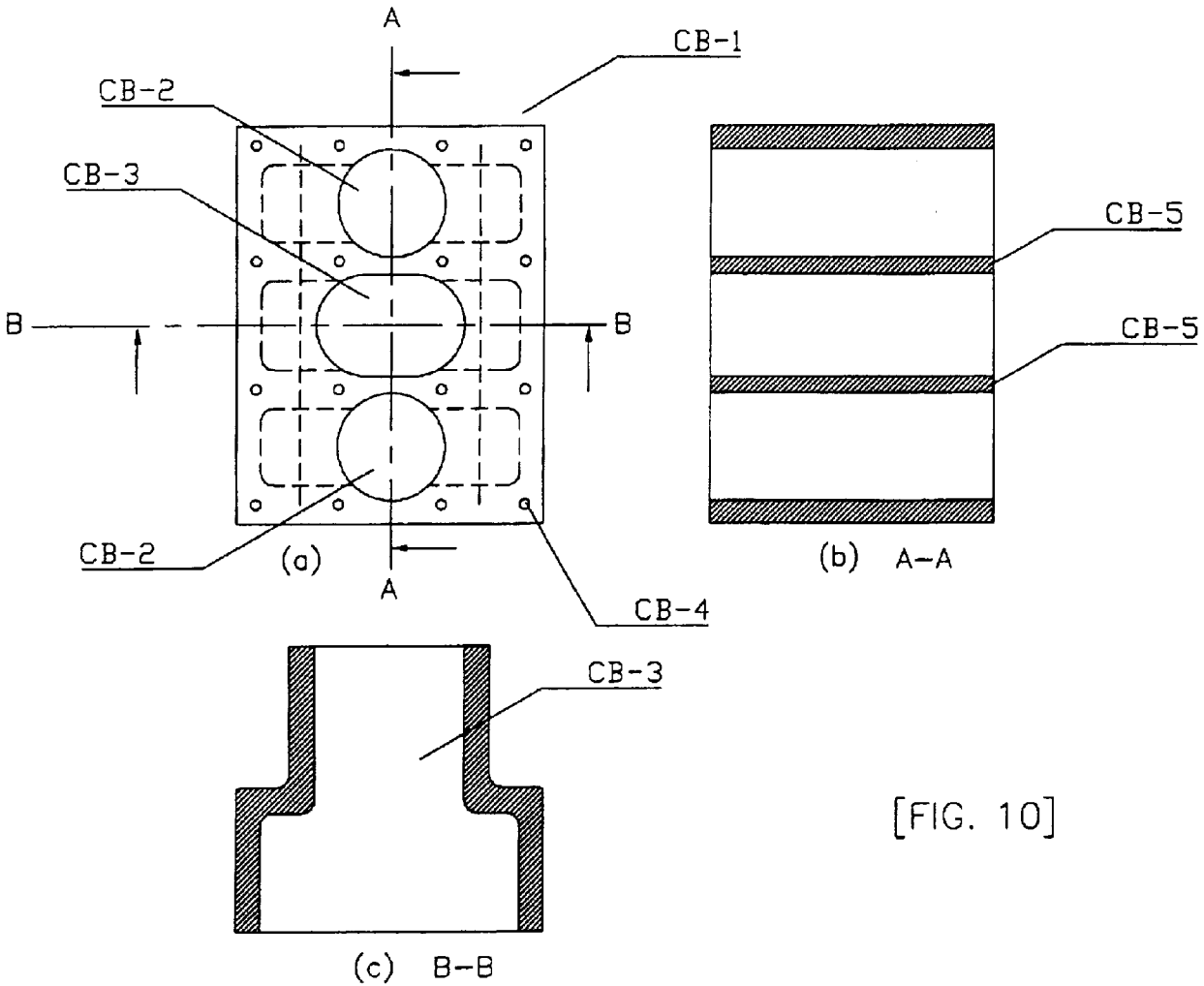
[FIG. 10]

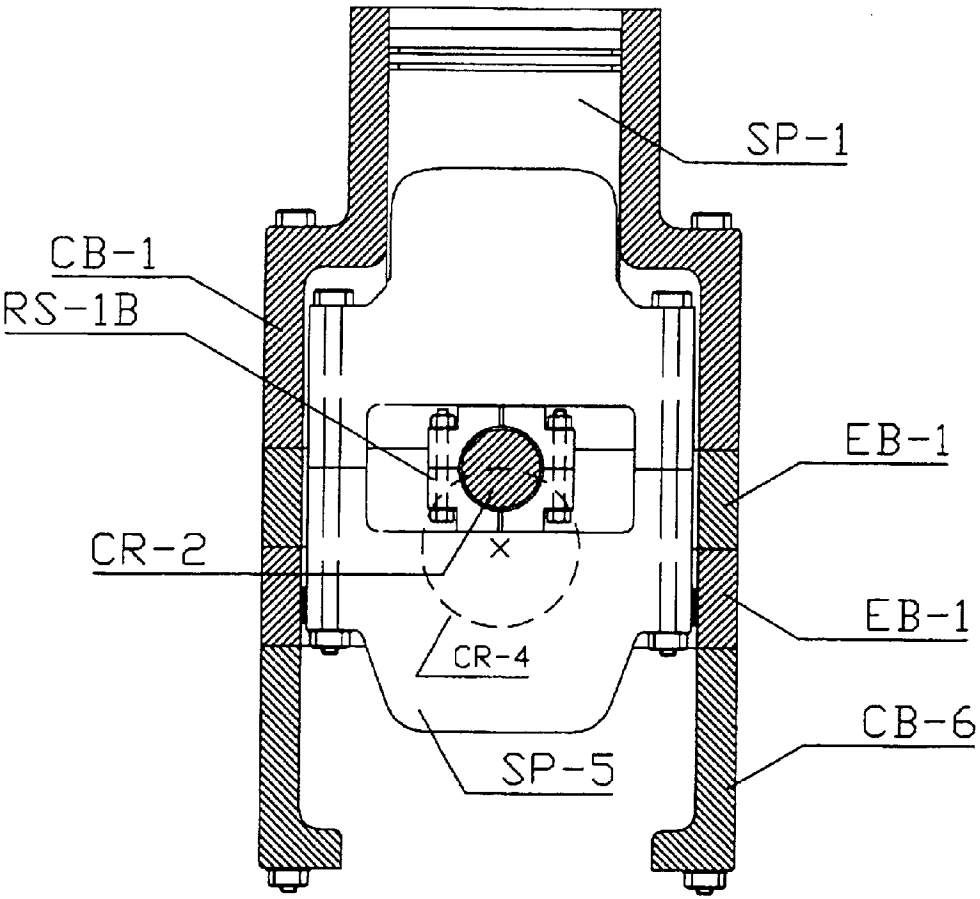
[FIG. 11]

4-STROKE RECIPROCATING PISTON ENGINE HAVING SUPERCHARGING PISTON

BACKGROUND OF THE INVENTION

1. Technical Field of the Invention

The present invention relates to a 4-stroke reciprocating piston engine having a supercharging piston.

2. Description of the Prior Arts (Patent Literature 1) and (Patent Literature 2) invented by the present applicant, for which a patent right has been respectively granted discloses a "Bidirectional type reciprocating piston engine composed of eight cylinders having a crankshaft including four crank pins and having a pair of bidirectional reciprocating pistons mounted on the respective crank pins."

[Patent Literature 1]

Japanese Patent Publication No. 3137283

[Patent Literature 2]

United States Patent Publication No. 5873339

However, although complete dynamic balance is ensured in the case of eight-cylinder construction described in (Patent Literature 1) and (Patent Literature 2), two pistons are mounted in a single crank pin in a bidirectional reciprocating piston engine, and in a case of four-cylinder construction, the number of crank pins becomes two, wherein there remains a problem in that it is impossible to secure dynamic balance as it is.

In a prior art piston engine, the four-cylinder configuration is most frequently used as a piston configuration. It is possible to widen the scope of application of a bidirectional reciprocating piston engine if a mechanism in which a construction having a fewer cylinders than the eight-cylinder construction is enabled in the bidirectional reciprocating piston engine.

SUMMARY OF THE INVENTION

Where a crankshaft including two crank pins is used in order to achieve a four-cylinder construction, it is impossible to secure complete dynamic balance by means of a combination of bidirectional reciprocating pistons.

Next, a case where a crankshaft including three crank pins by adding one crank pin thereto is considered.

In the crankshaft having three crank pins, the dynamic balance can be secured if, where the crank pins at both sides thereof have the same phase, which has a phase difference of 180° with respect to the middle crank pin, a pair of dummy bidirectional reciprocating pistons are mounted with respect to the middle crank pin, and a bidirectional reciprocating power piston carrying out one cycle of four strokes of air intake, compression, explosion and exhaust is provided in the crank pins at both sides, respectively, the centrifugal forces of the two pairs of bidirectional reciprocating power pistons are equal to each other, and the total centrifugal forces thereof are made equal to the centrifugal force of one pair of bidirectional reciprocating dummy pistons.

Also, the centrifugal force of the bidirectional reciprocating piston is expressed by the following expression (This is the centrifugal force at the elevation end and lowering end of a piston of the bidirectional reciprocating piston engine)

$$\text{Centrifugal force } F = Mr\omega^2$$

(where F is a force (N), M is mass [Kg] of the piston, r is a rotation radius [m] of the crank pin, ω is a rotational speed [1/sec.])

Therefore, it becomes possible to secure the dynamic balance by adjusting not only the mass of the piston but also the rotational radius of the crank pin.

For example, if, with respect to the radius of the crank pin of the bidirectional reciprocating power piston, the radius of the crank pin of the bidirectional reciprocating dummy piston is made larger by 1.25 times and the mass thereof is made larger by 1.6 times as well, the centrifugal force of the bidirectional reciprocating dummy piston becomes larger by two times than the centrifugal force of the bidirectional reciprocating power piston (that is, 1.25×1.6=2 times) thereby the dynamic balance is achieved.

Also, if the rotational radius of the crank pins is the same, it may be satisfactory that the mass of one pair of the bidirectional reciprocating dummy pistons is made larger by two times than one pair of the bidirectional reciprocating power pistons.

Therefore, addition of dummy pistons is one of the solutions for the construction of fewer cylinders than the eight-cylinder construction. However, the dummy pistons will not bring about any additional improvement of an engine other than improvement in the dynamic balance. The additional improvement is described below.

If a piston having specified functions is used in place of an dummy piston although a problem pertaining to only the dynamic balance can be solved by adding the dummy engine, it becomes possible to improve other functions of an engine in addition to the solution of the dynamic balance thereof.

If a supercharging piston whose object is to supply more air to a power piston than the exhaust capacity thereof is mounted as a piston having certain functions, a number of advantages described later can be brought about.

A description is given below of the functions that can be obtained by mounting a supercharging piston on the crankshaft instead of the dummy piston.

FIG. 2 shows a view describing a bidirectional reciprocating piston engine.

Herein, it is assumed that a piston carrying out one cycle of four strokes of air in take, compression, explosion and exhaust is called a "power piston" and a piston carrying out one cycle of two strokes of air intake and air supply is called a "supercharging piston."

Further, it is assumed that two power pistons (PP-1) combined as a bidirectional reciprocating piston is called "a pair of bidirectional reciprocating power pistons," and supercharging pistons (SP-1) are called "a pair of bidirectional reciprocating supercharging pistons" as well.

Next, a description is given of a case where two pairs of bidirectional reciprocating power pistons and one pair of bidirectional reciprocating supercharging pistons are mounted on a crankshaft (CR-1) having three crank pins (CR-2).

First, a description is given of the actions thereof.

In FIG. 2, since a pair of bidirectional reciprocating supercharging pistons mounted on the middle crank pin (CR-2) have a function as the above-described dummy pistons, it is clear that complete dynamic balance is secured among all the pistons.

Since three pairs of bidirectional reciprocating pistons are mounted on the crankshaft (CR-1), three pistons are mounted at the left half part and the right half part centering around the shaft of the crankshaft (CR-1), respectively.

The dynamic balance can be secured with only the three pistons at the right half part or with only the three pistons at the left half part.

The arrangement order of the pistons is a power piston, a supercharging piston, and a power piston from the axial tip end side of the crankshaft (CR-1) toward the axial rear end side.

The arrangement order of the three pistons constitutes a combination of pistons to establish the dynamic balance at the minimum unit.

Hereinafter, the arrangement order of the three pistons is called "PSP arrangement" assigned the capital letters thereof.

Therefore, in the case of three pairs of bidirectional reciprocating pistons, it can be considered that there are two sets of PSP arrangements.

Herein, although it has been described that the PSP arrangement can have dynamic balance, a description is given where the PSP arrangement is further provided with characteristic engine functions.

The actions of the PSP arrangement will be as follows.

The power piston carries out an action of one cycle consisting of four strokes which are air intake, compression, explosion and exhaust. On the other hand, the supercharging piston carries out an action of one cycle consisting of two strokes which are air intake and air supply. Therefore, since the supercharging piston carries out an air supplying action two times in the four strokes, a single supercharging piston will be able to carry out an air supply with respect to two power pistons by taking a matching of the respective strokes into consideration. A description is given below of the action states thereof.

(PSP Arrangement)

FIG. 1 shows a conceptual view of "PSP Arrangement—Supercharging Piston, Power Piston, and Valve layout." The conceptual view is applicable to not only a connecting rod type piston but also a bidirectional and unidirectional reciprocating pistons. Also, although FIG. 2 is a view describing the bidirectional reciprocating piston engine, the piston configuration is provided so that two power pistons (PP-1) and one supercharging piston (SP-1) are secured at both the left side and right side of the crankshaft (CR-1), and is composed of two sets of PSP arrangements. The following describes the functions thereof.

Although the power pistons (PP-1) repeat one cycle of four strokes consisting of air intake, compression, explosion and exhaust, and the supercharging piston (SP-1) repeats one cycle of two strokes consisting of air intake and air supply, it is possible to secure matching of the supercharging piston (SP-1) and power pistons (PP-1) by shifting the functioning order per power piston (PP-1).

The operation stroke of the bidirectional reciprocating piston engine (two sets of PSP arrangement) is shown in Table 1 below.

In the following Table 1, reference number *1 indicates that compressed air is sent from the left supercharging piston to the left No. 1 power piston in the first stroke. And reference numbers *2, *3 and *4 indicate matching between the supercharging piston and power pistons in the second stroke, third stroke and fourth stroke, respectively.

Also, the explosion stroke is carried out in respective power pistons one after another in the first stroke through the fourth stroke. A case of a connection rod type piston configuration (one set of PSP arrangement) or a unidirectional reciprocating piston engine (one set of PSP arrangement) corresponds to the right half part or the left half part in Table 1 below.

TABLE 1

| | Left No. 1 power piston | Right No. 1 power piston |
|---|---|---|
| 1st stroke | Air intake stroke *1 | Compression stroke |
| 2nd stroke | Compression stroke | Explosion stroke |
| 3rd stroke | Explosion stroke | Exhaust stroke |
| 4th stroke | Exhaust stroke | Air intake stroke *4 |

TABLE 1-continued

| | Left supercharging piston | Right supercharging piston |
|---|---|---|
| 1st stroke | Air supply stroke *1 | Air intake stroke |
| 2nd stroke | Air intake stroke | Air supply stroke *2 |
| 3rd stroke | Air supply stroke *3 | Air intake stroke |
| 4th stroke | Air intake stroke | Air supply stroke *4 |
| | Left No. 2 power piston | Right No. 2 power piston |
| 1st stroke | Explosion stroke | Exhaust stroke |
| 2nd stroke | Exhaust stroke | Air intake stroke *2 |
| 3rd stroke | Air intake stroke *3 | Compression stroke |
| 4th stroke | Compression stroke | Explosion stroke |

The following functions and features can be obtained by one set of PSP arrangement constructed as described above.

1. Functions of the 4-Stroke Engine

Two power pistons carry out four strokes of air intake, compression, explosion and exhaust of a 4-stroke engine.

2. Supercharging Function

One supercharging piston carries out supercharging for two power pistons.

3. Dynamic Balance Function and Increase in Output

Since dynamic balance can be secured by three pistons in total, consisting of two power pistons and one supercharging piston, the dynamic balance is completed in a short spacing among the three crank pins. In the case of the PSP arrangement, the rigidity of the crankshaft can be increased larger than a prior art piston arrangement.

Since the dynamic balance is completed per set of PSP arrangement, the rigidity of the crankshaft is increased, wherein it becomes easier to increase the PSP arrangement from one set to a plurality of sets, and an increase in output can be easily achieved.

4. Decrease in the Burden of the Crankshaft

With respect to a crankshaft having a number of crank pins, although there is almost no case where a crankshaft is provided with nine crank pins in the prior art piston engines, the dynamic balance is completed among the three crank pins in a case of the PSP arrangement, and only generated rotational torque is transmitted to the downstream crankshaft, wherein the burden of the crankshaft can be decreased, a crankshaft having nine crank pins will be subjected to practical applications.

In the crankshaft having nine crank pins, three sets of PSP arrangements can be incorporated in a case where unidirectional reciprocating pistons are mounted, and six sets of PSP arrangements can be incorporated in a case where bidirectional reciprocating pistons are mounted.

In the above case, the phases of three crank pins corresponding to the PSP arrangement are shifted by 120° per crank pin unit, and the interval of the explosion stroke can be shortened by the shifting, wherein components such as a flywheel are not required to decrease the number of components, and the rotation of the crankshaft can be smoothened.

5. Profile of the Piston

Pistons used for the PSP arrangement are effective regardless of the types thereof. The PSP arrangement is effective for not only prior art pistons each using a connection rod but also bidirectional reciprocating pistons shown in FIG. 2 or unidirectional reciprocating pistons shown in FIG. 11.

As described above, the following advantageous effects can be brought about according to a 4-stroke reciprocating piston engine provided with a supercharging piston of the invention.

According to the first aspect of the invention, the following effects can be brought about.

(1) A 4-stroke reciprocating piston engine can be achieved, which has dynamic balance by the PSP arrangement featured in the configuration of one supercharging piston and two power pistons, that is, a crankshaft having three crank pins.

(2) Since the engine output can be increased by supercharging, a 4-stroke reciprocating piston engine can be achieved, which is able to make up for an increase in the cubic capacity and weight of an engine resulting from addition of a supercharging piston, and is excellent in saving its installation space.

(3) The number of PSP arrangements may be increased in addition to an increase in the exhaust capacity as means for increasing the output of an engine. Also, since dynamic balance is completed with only a single PSP arrangement, it becomes easier to increase the output of an engine, wherein a configuration from small output to large output can be achieved. In the case of large output, if a bidirectional piston is mounted at a crankshaft having six crank pins, four sets of PSP arrangements can be brought about. Further, if a bidirectional piston is mounted at a crankshaft having nine crank pins, six sets of PSP arrangements can be brought about. A 4-stroke reciprocating piston engine, having large output like this, which is excellent in universal applications can be achieved.

(4) Since air supply brought about by the piston does not cause any delay in time as in a turbo charger, a 4-stroke reciprocating piston engine having satisfactory engine response, which has excellent reliability, can be achieved.

(5) Since the power pistons and supercharging pistons according to the structure of the bidirectional reciprocating piston do-not use any connection rod, it is possible to increase the heat transitivity of the pistons. Since the cooling capacity of the pistons is high, it is possible to fire a further greater volume of fuel than in general pistons, wherein a 4-stroke reciprocating piston engine which is able to obtain greater output can be achieved.

(6) Since the bidirectional reciprocating piston does not use any connection rod, a 4-stroke reciprocating piston engine having high reliability can be achieved, in which no harmonic component is generated, and vibrations can be reduced to a large extent.

(7) In the case of a 4-cylinder configuration in prior art piston engines, the dynamic balance is secured with the entirety of the four cylinders. That is, in this case, the dynamic balance is obtained in the entire length of the crankshaft having four crank pins.

Also, in the case of a series 6-cylinder configuration, the dynamic balance is secured with the entirety of the six cylinders. That is, in this case, the dynamic balance is obtained in the entire length of the crankshaft having six crank pins.

To the contrary, in a bidirectional reciprocating piston engine of PSP arrangement type, complete dynamic balance is secured by the pistons attached to a crankshaft having three crank pins. Only a short length of the crankshaft is sufficient to secure dynamic balance, wherein this leads to high rigidity, and vibrations can be efficiently suppressed.

Even if two sets of PSP arrangements are connected in series, dynamic balance may be secured for each set of the three crank pins, wherein it is sufficient that rotation torque generated in one PSP arrangement is only transmitted to the next PSP arrangement. Therefore, burden of the crankshaft is reduced, and vibrations can be decreased to a large extent. As a result, practical application of a crankshaft having nine crank pins, which is not presently achievable, will be enabled.

(8) The supercharging piston itself has a supercharging function. Additionally, air supply to the supercharging piston cylinder from a turbo charger is also enabled. Therefore, a 4-stroke reciprocating piston engine of high output, which is able to increase the supercharging effect, can be brought about.

According to the second aspect of the invention, the following effect can be brought about in addition to the effects according to the first aspect.

(1) If a unidirectional piston is mounted on a crankshaft having three crank pins, a set of PSP arrangements is established. With such a configuration, a small-sized 4-stroke reciprocating piston engine having less vibration can be achieved.

According to the third aspect of the invention, the following effect can be brought about in addition to the effects according to the first or second aspect.

(1) Since the supercharging piston does not fire any fuel therein, it produces less strain. Therefore, the sectional area profile of the piston may be made not only circular but also like a running track, which is shaped by adding a semi-circle to both sides of a rectangle, or elliptical. Therefore, a 4-stroke reciprocating piston engine can be achieved, which is able to increase the exhaust capacity of the supercharging piston without increasing the length of the crankshaft and excellent in saving its installation space.

According to the fourth aspect of the invention, the following effect can be brought about in addition to the effects according to the second or third aspect.

(1) In a prior art connection rod type piston, a small-sized 4-stroke reciprocating piston engine having capacity and low vibration, which are equivalent to those in a prior art 4-cylinder configuration, can be achieved.

According to the fifth aspect of the invention, the following effects can be brought about in addition to the effects according to any one of the first through fourth aspects.

(1) Since it is possible to provide six sets of PSP arrangements using bidirectional reciprocating pistons, a large capacity 4-stroke reciprocating piston engine having low vibration can be achieved.

(2) By shifting the phases of the three crank pins corresponding to the PSP arrangements by 120° per crank pin, a 4-stroke reciprocating piston engine having smooth output can be achieved, by which uniform explosion strokes can be obtained.

DESCRIPTION OF THE DRAWINGS

FIG. 1 is a conceptual view of PSP arrangement—Supercharging piston, power piston and valve layout;

FIG. 2 is a view describing a bidirectional reciprocating piston engine according to Embodiment 1 of the invention;

FIG. 3 is a sectional view showing the major parts of the bidirectional reciprocating piston;

FIG. 4(*a*) and (*b*) are, respectively, a front elevational view of a rotating slider and a right side elevational view thereof;

FIG. 5 is a sectional view taken along the line A—A in FIG. 2;

FIGS. 6(*a*) and (*b*) are, respectively, a front elevational view of a crankshaft and a left side elevational view thereof;

FIGS. 7(*a*), (*b*), (*c*) and (*d*) are, respectively, a front elevational view of a supercharging piston, a plan view thereof, a right side elevational view thereof, and a sectional view thereof taken along the line A—A;

FIGS. 8(*a*), (*b*), (*c*) and (*d*) are, respectively, a front elevational view of a power piston, a plan view thereof, a right side elevational view thereof, and a sectional view thereof taken along the line A—A;

FIGS. 9(*a*), (*b*) and (*c*) are, respectively, a front elevational view of an engine bed, a right side elevational view thereof, and a bottom view thereof.

FIG. 10 is a front elevational view of a cylinder block, a sectional view thereof taken along the line A—A, and a sectional view thereof taken along the B—B, and FIG. 11 is a sectional view showing the major parts of a unidirectional reciprocating piston engine according to Embodiment 2.

DESCRIPTION OF THE PREFERRED EMBODIMENTS

Hereinafter, a description is given of embodiments of the invention, referring to the drawings.

Embodiment 1

FIG. 1 is a conceptual view showing "PSP arrangement—supercharging piston, power piston, and valve layout."

The function corresponds to a reciprocating piston engine having one supercharging piston and two power pistons. The drawing is applicable to not only a connection rod type piston engine but also a bidirectional reciprocating piston engine and a unidirectional reciprocating piston engine. Respective names of pistons are organized as follows.

Respective types of pistons are named, as shown below, on the basis of the functions and structure of the pistons.

As the names showing the functions of piston, a piston having the function consisting of air intake, compression, explosion and exhaust is called a "power piston," and a piston having the function consisting of air intake and air supply, which is engaged in supercharging the power piston is called a "supercharging piston."

On the other hand, as the names showing the structure of pistons, a type in which two pistons are provided opposite to each other is called a "bidirectional reciprocating piston," a type having one piston is called a "unidirectional reciprocating piston," and a type using a connection rod is called a "connection rod type piston."

Although the connection rod type piston is a kind of unidirectional reciprocating piston, it bears a different name in order to distinguish it from a mold type unidirectional reciprocating piston.

Therefore, there are two types in the bidirectional reciprocating piston, one of which is a "bidirectional reciprocating power piston" and the other of which is a "bidirectional reciprocating supercharging piston."

Similarly, there are two types in the unidirectional reciprocating piston, one of which is a "unidirectional reciprocating power piston" and the other of which is a "unidirectional reciprocating supercharging piston."

In the connection rod type piston, there are two types, one of which is a "connection rod type power piston," and the other of which is a "connection rod type supercharging piston."

In FIG. 1, the crankshaft (CR-1) includes three crank pins (CR-2). One supercharging piston (SP-1) is mounted on the middle crank pin (CR-2). And, a power piston (PP-1) is mounted on two crank pins (CR-2) at both sides, respectively. The two power pistons (PP-1) at both sides have the same phase which has a difference in phase by 180° from the middle supercharging piston (SP-1). Therefore, it is possible to secure complete dynamic balance among the three crank pins (CR-2) by taking the masses of the pistons into consideration.

An air intake opening portion (IN-2) of compressed air having an air intake valve (VL-2) of compressed air and an exhaust opening portion (OT-2) having an exhaust valve (VL-3) are mounted on the cylinder head (CH-1) of a power piston cylinder (CB-2).

An air intake opening portion (IN-1) having an air intake valve (VL-1) and an opening portion (OT-1) for compressed air supply are mounted on the cylinder head (CH-1) of the supercharging piston cylinder (CB-3). Also, a crankcase (CR-3) is formed on the base of the respective cylinders.

FIG. 1 shows a state just before the supercharging piston begins elevating. As the supercharging piston (SP-1) elevates in the supercharging piston cylinder (CB-3) of the cylinder block (CB-1), the air intake valve (VL-1) is closed, and air is supplied from the opening portion (OT-1) for compressed air supply, wherein the two power pistons (PP-1) descend in the power piston cylinder (CB-2).

Where the power pistons (PP-1) descend, there are two types in the action mode of the power pistons (PP-1), one of which is the air intake stroke, and the other of which is the explosion stroke, wherein, when one of the power pistons (PP-1) is in the air intake stroke, the other power piston (PP-1) is in the explosion stroke.

In FIG. 1, when the left side power piston (PP-1) in the air intake stroke descends, the air intake valve (VL-2) of compressed air is opened, and compressed air is taken into the power piston cylinder (CB-2). On the other hand, since the air intake valve (VL-2) of compressed air is closed at the right side power piston (PP-1) in the explosion stroke, compressed air is supplied into only one power piston cylinder (CB-2) at all times.

Next, when the supercharging piston (SP-1) descends in the supercharging piston cylinder (CB-3), the air intake valve (VL-1) is opened, and air intake is commenced through the air intake opening portion (IN-1).

At this time, there are two action modes in the two power pistons (PP-1), one of which is the compression stroke, and the other of which is the exhaust stroke. Where one of the power pistons (PP-1) is in the compression stroke, the other power piston is in the exhaust stroke.

In the compression stroke, both the air intake valve (VL-2) of compressed air for the power piston and the exhaust valve (VL-3) are closed. On the other hand, in the exhaust stroke, the exhaust valve (VL-3) is open although the air intake valve (VL-2) of the power piston is closed.

FIG. 2 is a view describing a bidirectional reciprocating piston engine according to Embodiment 1. The mechanism corresponds to two sets of PSP arrangements.

In FIG. 2, a pair of engine beds support the crankshaft (CR-1) rotatably, and RS-LA denotes a rotating slider rotatably disposed on the crank pin (CR-2).

The power piston (PP-1) and supercharging piston (SP-1) are disposed leftward and rightward of the crank pin (CR-2), and are housed in the power piston cylinder (CB-2) and supercharging piston cylinder (CB-3), which are formed on the cylinder block (CB-1) disposed opposite thereto.

It can be considered that the piston position in FIG. 2 is the commencement of the 1st stroke. The 2nd stroke, 3rd stroke and 4th strokes are commenced whenever the crankshaft (CR-1) is turned by 180°, and the stroke is returned to the 1st stroke when the crankshaft (CR-1) finishes the second turn.

Next, a description is given of the contact surface between the pistons and the rotating slider.

FIG. 3 is a sectional view of the major parts of the bidirectional reciprocating piston, FIG. 4(*a*) is a front elevational view of the rotating slider, and FIG. 4(*b*) is a right side elevational view thereof.

In FIG. 3, the rotating sliders (RS-1A and 1B) are rotatably mounted on the crank pin (CR-2), and the two sliding planes thereof are brought into contact with the sliding planes at the lower part of a pair of pistons. There are two types in the profile of the planes on which the rotating sliders and pistons are brought into contact with each other, which may be selectively used in accordance with the profile of the pistons.

For example, where the profile of the piston is cylindrical, since there may be a case where the piston turns around the center axis if the contact plane between the piston and rotating slider is flat, the arm part of the piston is brought into contact with the arm of the crankshaft in this case. In order to prevent this, it is necessary to prevent the piston from turning by making the profile of the contact plane (RS-2) arcuate between the rotating slider (RS-1A) and the piston as shown in FIG. 4.

To the contrary, where the piston is not cylindrical but elliptical, since the piston itself prevents it from turning, it is necessary to make the contact plane flat between the rotating slider and the piston as in the rotating slider (RS-1B) mounted on the supercharging piston (SP-1) in FIG. 3.

This is because if the turning of the piston is restricted at two points, there is a possibility for the piston to be distorted. Therefore, it is determined by the profile of the piston whether the contact plane between the piston and the rotating slider is made flat or partially cylindrical.

In FIG. 4, lubricant oil for the contact plane (RS-2) between the rotating slider (RS-1A) and the piston is supplied through a lubricant oil path (RS-4) communicating from the contact plane (RS-3) between the rotating slider (RS-1A) and the crank pin (CR-2) toward the contact plane (RS-2) between the slider and the piston. The gas pressure applied to the piston is effectively transmitted to the crank pin via the rotating slider.

FIG. 5 is a sectional view taken along the line A—A in FIG. 2.

A bidirectional reciprocating supercharging piston is formed by placing the rotating slider (RS-1B) rotatably mounted on the crank pin (CR-2) between the supercharging pistons (SP-1) opposed each other and tightening it by bolt. The configuration similar to the above is applied to the bidirectional reciprocating power pistons.

With respect to transmission of a force between the piston and crankshaft, reciprocating actions of the power pistons cause the crankshaft to rotate in the case of the power pistons.

To the contrary, in the case of the supercharging piston, the supercharging piston makes reciprocating actions by the rotating force of the crankshaft.

Since the bidirectional reciprocating power piston reciprocates in the power piston cylinder, and at the same time, the rotating slider reciprocates in the elongated hole-shaped crank drive portion formed at the middle portion of the bidirectional reciprocating power piston, the crank pin and crankshaft are caused to rotate. The crank pin (CR-2) carries out a rotating action so as to depict a rotation locus (CR-4) by the rotation force of the crankshaft (CR-1). At the same time, the rotating slider reciprocates in the direction of the arrow, and the bidirectional reciprocating supercharging piston reciprocates in the supercharging piston cylinder (CB-3).

Next, a description is given of the crankshaft (CR-1).

FIG. 6(*a*) is a front elevational view of the crankshaft, and FIG. 6(*b*) is a left side elevational view thereof.

In FIG. 6, the crankshaft (CR-1) has three crank pins (CR-2) and is provided with counterweights (CR-5) and (CR-6) at both sides thereof. The crank pins (CR-2) at both sides have the same phase and have a difference by 180° in phase with respect to the middle crank pin (CR-2).

Next, a description is given of the profile of the piston.

FIGS. 7(*a*) through (*d*) are, respectively, a front elevational view, plan view, right side elevational view, and sectional view taken along the line A—A of the supercharging piston.

In FIG. 7, reference symbol SP-2 denotes the arm portion of the supercharging piston, SP-3 denotes the contact plane with the rotating slider, and SP-4 denotes an attaching bolt hole to couple the pistons together.

The profile of the supercharging piston is like a running track which is shaped by adding a semi-circle to both sides of a rectangle, whereby the sectional area of the piston can be increased without increasing the length of the crankshaft. Also, if the profile is made elliptical, similar effects can be obtained.

Further, since the cross-sectional shape of the flat plate portion located at the intermediate section between the top part of the piston and the piston leg part is made in the form of H-shaped steel, the strength of the piston is increased.

Thus, by consideration of the piston profile and combination of materials having strength, it is possible to integrate the portions corresponding to the prior art piston, piston pin and connection rod by molding.

FIGS. 8(*a*) through (*d*) are, respectively, a front elevational view, plan view, right side elevational view, and sectional view taken along the line A—A of the power piston.

In FIG. 8, reference symbol PP-2 denotes a power piston arm portion, PP-3 denotes the contact plane with the rotating slider, and PP-4 denotes an attaching bolt hole to couple the pistons together.

With respect to the profile of the power piston, a circular shape is further superior than an elliptical shape or a running track-like shape in view of heat efficiency. However, in the elliptical or running track-like shape, a worsening in the combustion efficiency can be considerably compensated by attaching an ignition plug or a fuel injection valve at two points. Also, since a high compression ratio can be obtained, the power pistons can be applied to not only a gasoline engine but also a diesel engine.

Next, a description is given of the engine bed.

FIGS. 9(*a*) through (*c*) are, respectively, a front elevational view, right side elevational view and an underside view of the engine bed.

The engine bed pieces (EB-1) are disposed opposite to each other, rotatably support the crankshaft by bearings (EB-2), and coupled to each other at bolt holes (EB-3).

The bidirectional reciprocating pistons are formed by coupling the pistons disposed opposite to each other by tightening the bolts. However, since the width of the piston in the axial direction of the crankshaft is usually larger than the width of the engine bed opening portion, it is necessary to tighten a pair of pistons using the bolts in a state where the engine bed is caused to pass under from the arm portion side of the respective pistons in advance.

Next, a description is given of the cylinder block.

FIGS. 10(*a*) through (*c*) are, respectively, a front elevational view of the cylinder block, sectional view thereof taken along the line A—A, and sectional view thereof taken along the line B—B.

The wall (CB-5) of the cylinder block close to the bearing portion of the crankshaft is made narrow since the distance between the pistons is short. Therefore, it becomes possible to lengthen the width of the bearing portion by separately preparing the engine bed, wherein necessary strength of the bearing can be obtained. The engine bed and cylinder block (CB-1) are coupled together by bolts in the bolt holes (CB-4).

With the bidirectional reciprocating piston engine, constructed as described above, according to Embodiment 1, compressed air can be supplied to the power pistons without any delay in time since the supercharging pistons are provided, wherein satisfactory response performance can be brought about, and large output can be also obtained. Also, since it is easy to combine a plurality of sets of engine mechanisms, such an action can be brought about, by which a further larger output can be obtained.

Embodiment 2

FIG. 11 is a sectional view showing the major parts of a unidirectional reciprocating piston engine according to Embodiment 2.

Also, parts which are the same as those in Embodiment 1 are given the same reference symbols and numbers, and description thereof is omitted.

In FIG. 11, reference symbol SP-5 denotes an arm body coupled to the supercharging piston disposed opposite to each other in place of the supercharging piston, CB-6 denotes a protection block that is disposed in place of the cylinder block (CB-1) and protects the arm body (SP-5). Also, the configuration thereof is common to the power piston.

Therefore, if the piston head portion at one side of the bidirectional reciprocating piston in FIG. 2 is removed, a unidirectional reciprocating piston that carries out reciprocating movement in a single direction can be established.

As described above, with the unidirectional reciprocating piston according to Embodiment 2, since the piston portion can be molded by a material having high heat transitivity, further greater volume of fuel can be fired in comparison with the piston system using a connection rod, wherein output per exhaust amount can be increased.

In addition, since it is not provided with any connection rod, no harmonic component is generated, wherein an engine having less vibrations can be obtained.

The unidirectional reciprocating piston engine is suitable as a piston engine having a smaller output than that of the bidirectional reciprocating piston engine.

(Modes for Carrying Out the Invention)

Hereinafter, a description is given of modes of the invention.

A 4-stroke reciprocating piston engine having a supercharging piston according to the first aspect includes: a cylinder block having cylinders and a crankcase formed at the base of the cylinders; a bidirectional reciprocating piston housed in the respective cylinders of the cylinder block disposed opposite thereto; an elongated hole-shaped crank drive portion formed at the middle part of the bidirectional reciprocating piston; a rotating slider slidably disposed on the crank drive portion; and a crankshaft having a crankpin to which the rotating slider is rotatably attached; and a pair of engine beds having a bearing portion of the crankshaft and being coupled with the cylinder block; and the 4-stroke reciprocating piston engine further comprises one or more sets of engine mechanisms each thereof including: two pairs of bidirectional reciprocating power pistons mounted at both ends of the crankshaft having three crank pins in series at the same phase; a pair of bidirectional reciprocating supercharging pistons mounted at the middle crank pin at a phase different by 180° with respect to the two pairs of bidirectional reciprocating power pistons in order to carry out supercharging; and a cylinder head on which an air intake opening portion having an air intake valve for enabling air intake into the bidirectional reciprocating supercharging piston cylinder, a pressurized air supply opening portion for supplying pressurized air from the bidirectional reciprocating supercharging piston cylinder to the bidirectional reciprocating power piston cylinder, a pressurized air intake opening portion having a pressurized air intake valve for taking pressurized air into the respective bidirectional reciprocating power piston cylinders, and an exhaust opening portion having an exhaust valve for exhausting gas from the respective bidirectional reciprocating power piston cylinders are formed.

A 4-stroke reciprocating piston engine having a supercharging piston according to the second aspect includes: a cylinder block having cylinders and a crankcase formed at the base of the cylinders; a unidirectional reciprocating piston housed in the respective cylinders; an elongated hole-shaped crank drive portion formed at the base of the unidirectional reciprocating piston; a rotating slider slidably disposed on the crank drive portion; and a crankshaft having a crank pin to which the rotating slider is rotatably attached; and the 4-stroke reciprocating piston engine further comprises one or more sets of engine mechanisms each thereof including: two unidirectional reciprocating power pistons mounted at both ends of the crankshaft having three crank pins in series at the same phase; a single unidirectional reciprocating supercharging piston mounted at the middle crank pin at a phase different by 180° with respect to the two unidirectional reciprocating power pistons in order to carry out supercharging; and a cylinder head on which an air intake opening portion having an air intake valve for enabling air intake into the unidirectional reciprocating supercharging piston cylinder, a pressurized air supply opening portion for supplying pressurized air from the unidirectional reciprocating supercharging piston cylinder to the unidirectional reciprocating power piston cylinder, a pressurized air intake opening portion having a pressurized air intake valve for taking pressurized air into the respective unidirectional reciprocating power piston cylinders, and an exhaust opening portion having an exhaust valve for exhausting gas from the respective unidirectional reciprocating power piston cylinders are formed. The mechanism is identical to the bidirectional reciprocating piston engine in the structure other than that the bidirectional reciprocating power piston according to the first aspect is substituted by a unidirectional reciprocating piston.

A 4-stroke reciprocating piston engine having a supercharging piston according to the third aspect is a 4-stroke reciprocating piston engine having a supercharging piston according to the first aspect or the second aspect, wherein the cross-sectional shapes of the bidirectional or unidirectional reciprocating supercharging pistons and/or the bidirectional or unidirectional reciprocating power pistons and cylinders housing the respective pistons are elliptical or like a running track which is shaped by adding a semi-circle to both sides of a rectangle.

A 4-stroke reciprocating piston engine having a supercharging piston according to the fourth aspect is a 4-stroke reciprocating piston engine according to the second aspect or the third aspect, and includes a connection rod engaged with the unidirectional reciprocating piston and the crank pin in place of the elongated hole-shaped crank drive portion formed at the base of the unidirectional reciprocating piston and the rotating slider slidably disposed at the crank drive portion.

The mechanism is identical to the unidirectional reciprocating piston engine in the structure other than that the unidirectional reciprocating piston is substituted by a connection rod type piston.

The 4-stroke reciprocating piston engine having a supercharging piston according to the fifth aspect is a 4-stroke reciprocating piston engine having a supercharging piston according to any one of the first through fourth aspects, wherein three sets of the engine mechanisms are disposed in-series on a single crankshaft with the phase of the crank pin shifted by 120° per set.

What is claimed is:

1. A 4-stroke reciprocating piston engine having a supercharging piston including a cylinder block having cylinders and a crankcase formed at the base of said cylinders; a bidirectional reciprocating piston housed in said respective cylinders of said cylinder block disposed opposite thereto; an elongated hole-shaped crank drive portion formed at the middle part of said bidirectional reciprocating piston; a rotating slider slidably disposed on said crank drive portion; and a crankshaft having a crank pin to which said rotating slider is rotatably attached; and a pair of engine beds having a bearing portion of said crankshaft and being coupled with said cylinder block; and said 4-stroke reciprocating piston engine further comprising one or more sets of engine mechanisms each including:

(a) two pairs of bidirectional reciprocating power pistons mounted in series at the same phase at both ends of said crankshaft having three crank pins;

(b) a pair of bidirectional reciprocating supercharging pistons mounted at the middle crank pin at a phase different by 180° with respect to said two pairs of bidirectional reciprocating power pistons in order to carry out supercharging; and (c) a cylinder head on which an air intake opening portion having an air intake valve for enabling air intake into said bidirectional reciprocating supercharging piston cylinder, a pressurized air supply opening portion for supplying pressurized air from said bidirectional reciprocating supercharging piston cylinder to said bidirectional reciprocating power piston cylinder, a pressurized air intake opening portion having a pressurized air intake valve for taking pressurized air into said respective bidirectional reciprocating power piston cylinders, and an exhaust opening portion having an exhaust valve for exhausting gas from said respective bidirectional reciprocating power piston cylinders are formed.

2. A 4-stroke reciprocating piston engine having a supercharging piston including a cylinder block having cylinders and a crankcase formed at the base of said cylinders; a unidirectional reciprocating piston housed in said respective cylinders; an elongated hole-shaped crank drive portion formed at the base of said unidirectional reciprocating piston; a rotating slider slidably disposed on said crank drive portion; and a crankshaft having a crank pin to which said rotating slider is rotatably attached; and said 4-stroke reciprocating piston engine further comprising one or more sets of engine mechanisms each including:

(a) two unidirectional reciprocating power pistons mounted at both ends of said crankshaft having three crank pins in series at the same phase;

(b) a single unidirectional reciprocating supercharging piston mounted at the middle crank pin at a phase different by 180° with respect to said two unidirectional reciprocating power pistons in order to carry out supercharging; and (c) a cylinder head on which an air intake opening portion having an air intake valve for enabling air intake into said unidirectional reciprocating supercharging piston cylinder, a pressurized air supply opening portion for supplying pressurized air from said unidirectional reciprocating supercharging piston cylinder to said unidirectional reciprocating power piston cylinder, a pressurized air intake opening portion having a pressurized air intake valve for taking pressurized air into said respective unidirectional reciprocating power piston cylinders, and an exhaust opening portion having an exhaust valve for exhausting gas from said respective unidirectional reciprocating power piston cylinders are formed.

3. A 4-stroke reciprocating piston engine having a supercharging piston as set forth in claim 1, wherein the cross-sectional shapes of said bidirectional reciprocating supercharging piston and/or said bidirectional reciprocating power pistons and cylinders housing said respective pistons are elliptical or like a running track which is shaped by adding a semi-circle to both sides of a rectangle.

4. A 4-stroke reciprocating piston engine having a supercharging piston as set forth in claim 2, wherein the cross-sectional shapes of said unidirectional reciprocating supercharging piston and/or said unidirectional reciprocating power pistons and cylinders housing said respective pistons are elliptical or like a running track which is shaped by adding a semi-circle to both sides of a rectangle.

5. A 4-stroke reciprocating piston engine a supercharging piston including a cylinder block having cylinders and a crankcase formed at the base of said cylinders; a connection rod type piston housed in said respective cylinders; and a crankshaft having a crank pin; and said 4-stroke reciprocating piston engine further comprising one or more sets of engine mechanisms each including:

(a) two connection rod type power pistons of said connection rod type pistons mounted at both ends of said crankshaft hair three crank pins in series at the same phase;

(b) a single connection rod type supercharging piston of said connection rod type pistons mounted at the middle crank pin at a phase different by 180° with respect to said two connection rod type power pistons in order to carry out supercharging; and (c) a cylinder head on which an air intake opening portion having an air intake valve for enabling air intake into a connection rod type supercharging piston cylinder, a pressurized air supply opening portion for supplying pressurized air from said connection rod type supercharging piston cylinder to connection rod type power piston cylinders, a pressurized air intake opening portion having a pressurized air intake valve for taking pressurized air into said respective connection rod type power piston cylinders, and an exhaust opening portion having an exhaust valve for exhausting gas from said respective connection rod type power piston cylinders are formed.

6. The 4-stroke reciprocating piston engine having a supercharging piston as set forth in any one of claims 1 through 3, 4 and 5, wherein three sets of said engine mechanisms arc disposed in series on a single crankshaft with the phase of said crankpin shifted by 120° per set.

* * * * *

UNITED STATES PATENT AND TRADEMARK OFFICE

CERTIFICATE OF CORRECTION

PATENT NO. : 6,871,497 B2
DATED : March 29, 2005
INVENTOR(S) : Daikichiro Isogai It is certified that error appears in the above-identified patent and that said Letters Patent is hereby corrected as shown below:

Column 5,
Line 36, change “transitivity” to -- transmitivity. --

Column 8,
Line 55, change “RS-LA” to “RS-1A”

Column 11,
Line 46, change “transitivity to -- transmitivity --

Column 14,
Line 33, insert -- having -- after “engine”
Line 41, change “hair” to -- having --
Line 65, put one space between “crank” and “pin”

Signed and Sealed this

Fourteenth Day of June, 2005

JON W. DUDAS
*Director of the United States Patent and Trademark Office*